US007918130B2

(12) United States Patent
Kortge

(10) Patent No.: US 7,918,130 B2
(45) Date of Patent: Apr. 5, 2011

(54) METHODS AND SYSTEMS TO IDENTIFY CAM PHASER HARDWARE DEGRADATION

(75) Inventor: Jerry W. Kortge, Clarkston, MI (US)

(73) Assignee: GM Global Technology Operations LLC

( * ) Notice: Subject to any disclaimer, the term of this patent is extended or adjusted under 35 U.S.C. 154(b) by 998 days.

(21) Appl. No.: 11/747,515

(22) Filed: May 11, 2007

(65) Prior Publication Data

US 2008/0281453 A1 Nov. 13, 2008

(51) Int. Cl.
*G01M 13/02* (2006.01)

(52) U.S. Cl. ..... 73/114.79

(58) Field of Classification Search ..... 73/114.79
See application file for complete search history.

(56) References Cited

U.S. PATENT DOCUMENTS

| | | | | |
|---|---|---|---|---|
| 5,937,806 | A * | 8/1999 | Lyko et al. | 123/90.15 |
| 6,488,008 | B1 * | 12/2002 | Jankovic et al. | 123/399 |
| 6,718,922 | B2 * | 4/2004 | Yasui | 123/90.17 |
| 6,885,976 | B2 * | 4/2005 | Yoshiki et al. | 702/185 |
| 6,912,981 | B2 * | 7/2005 | Davis et al. | 123/90.12 |
| 7,047,924 | B1 * | 5/2006 | Waters et al. | 123/90.16 |
| 7,059,285 | B2 * | 6/2006 | Schafer et al. | 123/90.15 |
| 7,350,487 | B1 * | 4/2008 | Pfeiffer et al. | 123/90.17 |
| 7,353,788 | B2 * | 4/2008 | Kortge | 123/90.17 |
| 7,438,046 | B2 * | 10/2008 | Okubo et al. | 123/321 |
| 7,584,044 | B2 * | 9/2009 | Mladenovic et al. | 701/102 |
| 2004/0016292 | A1 * | 1/2004 | Kawamura et al. | 73/118.1 |
| 2007/0239343 | A1 * | 10/2007 | Okubo et al. | 701/105 |
| 2009/0145384 | A1 * | 6/2009 | Cinpinski et al. | 123/90.17 |

* cited by examiner

*Primary Examiner* — Freddie Kirkland, III

(57) ABSTRACT

A cam phaser diagnostic system is provided. The system includes: a first sample variance module that computes a first variance based on a desired cam phaser position. A second sample variance module computes a second variance based on a measured cam phaser position. An evaluation module diagnoses faulty cam phaser operation based on the first variance and the second variance.

18 Claims, 5 Drawing Sheets

METHODS AND SYSTEMS TO IDENTIFY CAM PHASER HARDWARE DEGRADATION

FIELD

The present disclosure relates to methods and systems for identifying degradation of cam phaser hardware.

BACKGROUND

The statements in this section merely provide background information related to the present disclosure and may not constitute prior art.

A cam phaser control system may include a cam phaser actuator imposed between an engine camshaft and a camshaft drive such that an engine valve timing may be varied. Some systems use engine oil as a hydraulic fluid to move the phaser actuator. Typically, the oil flowing into or out of the actuator is controlled by a multi-port, electrically-controlled oil control valve (OCV). The position of the OCV (and, thus, the flow of oil into or out of a specific port of the actuator) is controlled via a Pulse Width Modulated (PWM) voltage source. A closed-loop controller imparts an appropriate PWM value to move the phaser actuator to a desired phaser position.

Due to degradation of either the cam phaser actuator, the OCV, or the oil supply source, the observed closed-loop control may significantly deviate from expected closed-loop control. For example, a rate of change of a measured phaser position may vary from a commanded change in desired phaser position. This variance may indicate that the phaser actuator is either moving slower than expected or moving faster than expected, depending on the specific type of degradation. These deviations may cause the vehicle driver to experience undesirable vehicle surge at varying levels.

SUMMARY

Accordingly, a cam phaser diagnostic system is provided. The system includes: a first sample variance module that computes a first variance based on a desired cam phaser position. A second sample variance module computes a second variance based on a measured cam phaser position. An evaluation module diagnoses faulty cam phaser operation based on the first variance and the second variance.

In other features, a method of diagnosing a cam phaser is provided. The method includes: computing a first variance based on a desired cam phaser position; computing a second variance based on a measured cam phaser position; and diagnosing faulty cam phaser operation based on the first variance and the second variance.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
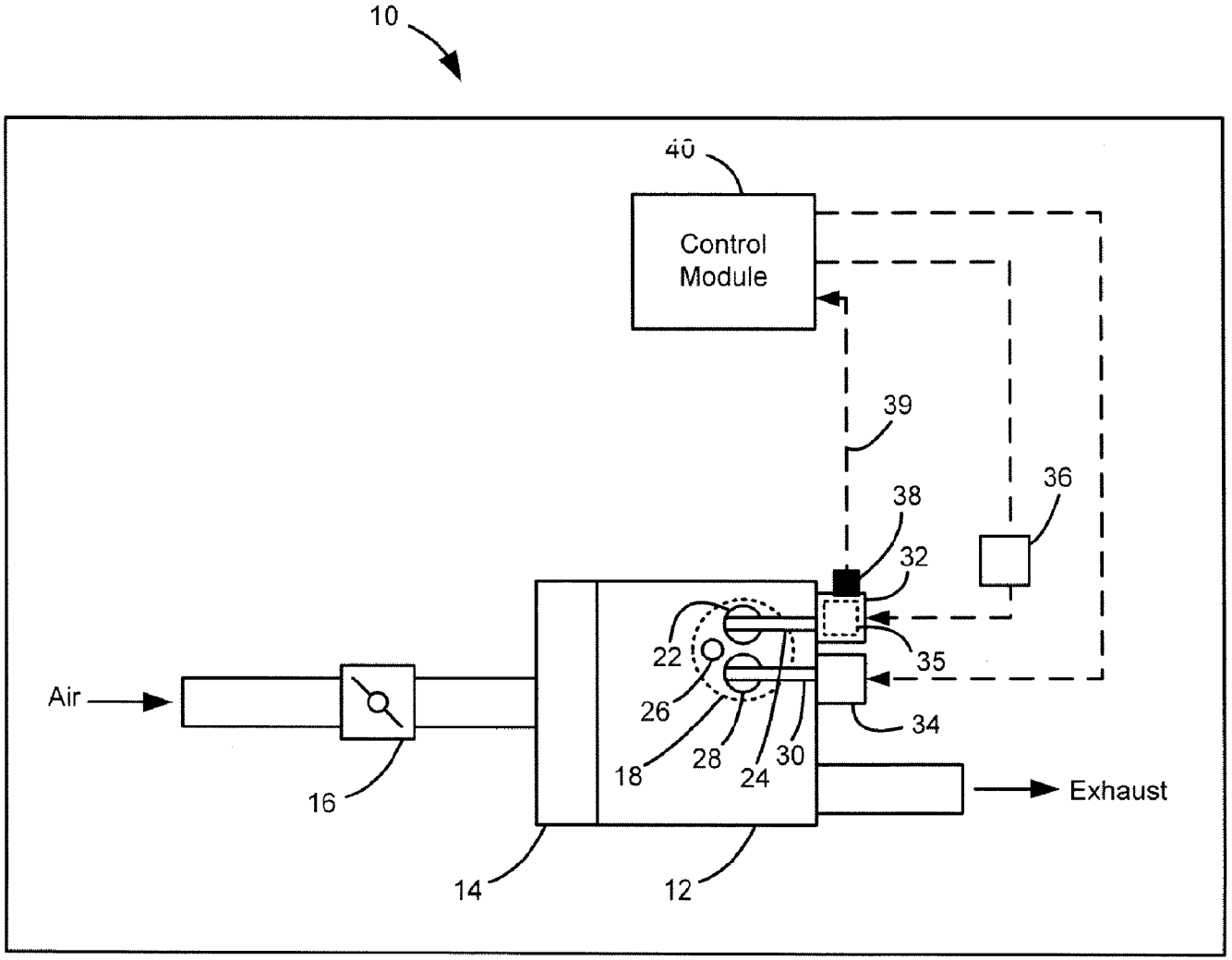
FIG. 1 is a functional block diagram illustrating a vehicle including a cam phaser control system in accordance with various aspects of the present disclosure.

The following description is merely exemplary in nature and is not intended to limit the present disclosure, application, or uses. It should be understood that throughout the drawings, corresponding reference numerals indicate like or corresponding parts and features. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Referring now to FIG. 1, a vehicle 10 includes an engine 12 that combusts an air and fuel mixture to produce drive torque. Air is drawn into an intake manifold 14 through a throttle 16. The throttle 16 regulates mass air flow into the intake manifold 14. Air within the intake manifold 14 is distributed into cylinders 18. Although a single cylinder 18 is illustrated, it is appreciated that the engine 12 can have a plurality of cylinders, including, but not limited to, 2, 3, 4, 5, 6, 8, 10, and 12 cylinders.

A fuel injector (not shown) injects fuel, which is combined with the air as it is drawn into the cylinder 18. The fuel injector may be an injector associated with an electronic or mechanical fuel injection system, a jet or port of a carburetor, or another system for mixing fuel with intake air. The fuel injector is controlled to provide a desired air-to-fuel (A/F) ratio within each cylinder 18.

An intake valve 22 selectively opens and closes to enable the air/fuel mixture to enter the cylinder 18. The intake valve position is regulated by an intake camshaft 24. A piston (not shown) compresses the air/fuel mixture within the cylinder 18. A spark plug 26 can initiate combustion of the air/fuel mixture, driving the piston in the cylinder 18. The piston drives a crankshaft (not shown) to produce drive torque. Combustion exhaust within the cylinder 18 is forced out when an exhaust valve 28 is in an open position. The exhaust valve position is regulated by an exhaust camshaft 30. The exhaust is treated in an exhaust system. Although single intake and exhaust valves 22, 28 are illustrated, it can be appreciated that the engine 12 can include multiple intake and exhaust valves 22, 28 per cylinder 18.

The engine 12 can include an intake cam phaser 32 and/or an exhaust cam phaser 34 (hereinafter referred to as a cam phaser 32) that respectively regulate the rotational timing of the intake and exhaust camshafts 24, 30. More specifically, the timing or phase angle of the respective intake and exhaust camshafts 24, 30 can be retarded or advanced with respect to each other or with respect to a location of the piston within the cylinder 18 or crankshaft position. In this manner, the position of the intake and exhaust valves 22, 28 can be regulated with respect to each other or with respect to a location of the piston within the cylinder 18. By regulating the position of the intake valve 22 and the exhaust valve 28, the quantity of air/fuel mixture ingested into the cylinder 18 and, therefore, the engine torque is regulated.

The cam phaser 32 can include a phaser actuator 35 that is either electrically or hydraulically actuated. Hydraulically actuated phaser actuators 35, for example, include an electrically-controlled oil control valve (OCV) 36 that controls oil flowing into or out of the phaser actuator 35. A control module 40 controls a position of the OCV 36 of the cam phaser 32. A position sensor 38 generates a measured cam phaser position signal 39 based on a measured position of the cam phaser 32. The control module 40 diagnoses the cam phaser 32 based on the measured cam phaser position signal 39 and cam phaser diagnostic systems and methods of the present disclosure.

Figure 2:
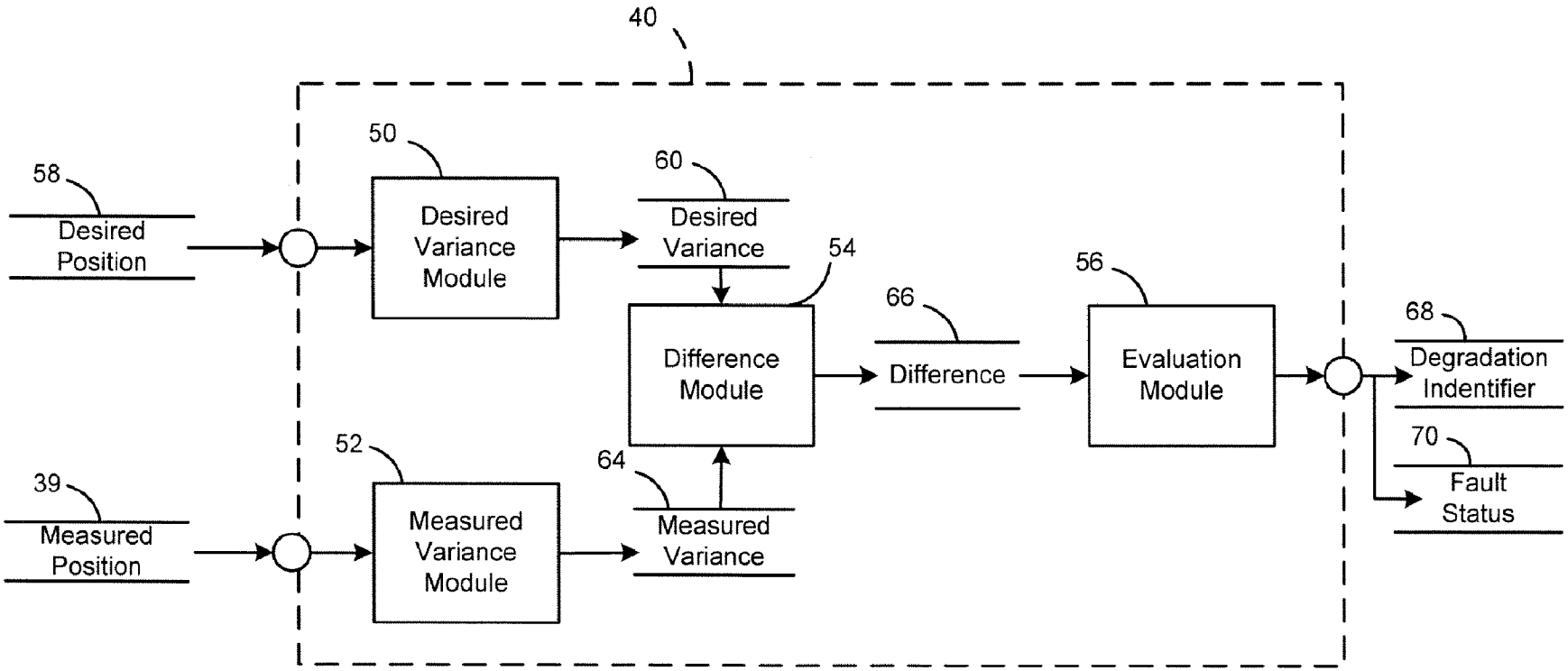
FIG. 2 is a dataflow diagram illustrating a cam phaser diagnostic system of the cam phaser control system in accordance with various aspects of the present disclosure.

Referring now to FIG. 2, a dataflow diagram illustrates various embodiments of a cam phaser diagnostic system that may be embedded within the control module 40. Various embodiments of cam phaser diagnostic systems according to the present disclosure may include any number of sub-modules embedded within the control module 40. As can be appreciated, the sub-modules shown may be combined and/or further partitioned to similarly identify degradation of cam phaser hardware. Inputs to the system may be sensed from the vehicle 10 (FIG. 1), received from other control modules (not shown) within the vehicle 10 (FIG. 1), and/or determined by other sub-modules (not shown) within the control module 40. In various embodiments, the control module 40 of FIG. 2 includes a desired variance module 50, a measured variance module 52, a difference module 54, and an evaluation module 56.

The desired variance module 50 receives as input a desired cam phaser position 58 determined based on current engine operating conditions. The desired variance module 50 computes a sample desired variance 60 based on the desired cam phaser position 58 over a sample period. As can be appreciated, the sample desired variance 60 can be computed based on variance equations known in the art. The measured variance module 52 receives as input the measured cam phaser position 39 generated from the cam phaser position sensor 38 of FIG. 1. The measured variance module 52 computes a sample measured variance 64 based on the measured cam phaser position 39. The sample measured variance 64 is computed over the same sample period that the desired variance module 50 uses to compute the sample desired variance 60. As can be appreciated, the sample measured variance 64 can be computed based on variance equations known in the art.

The difference module 54 receives as input the desired variance 60 and the measured variance 64. The difference module 54 computes a difference 66 between the desired variance 60 and the measured variance 64 by subtracting the measured variance 64 from the desired variance 60. In various embodiments, the difference module applies an offset to the desired variance 60 or the measured variance 64 before computing the difference. The offset can be applied to compensate for noise in the measured cam phaser position signal 39.

Figure 3:
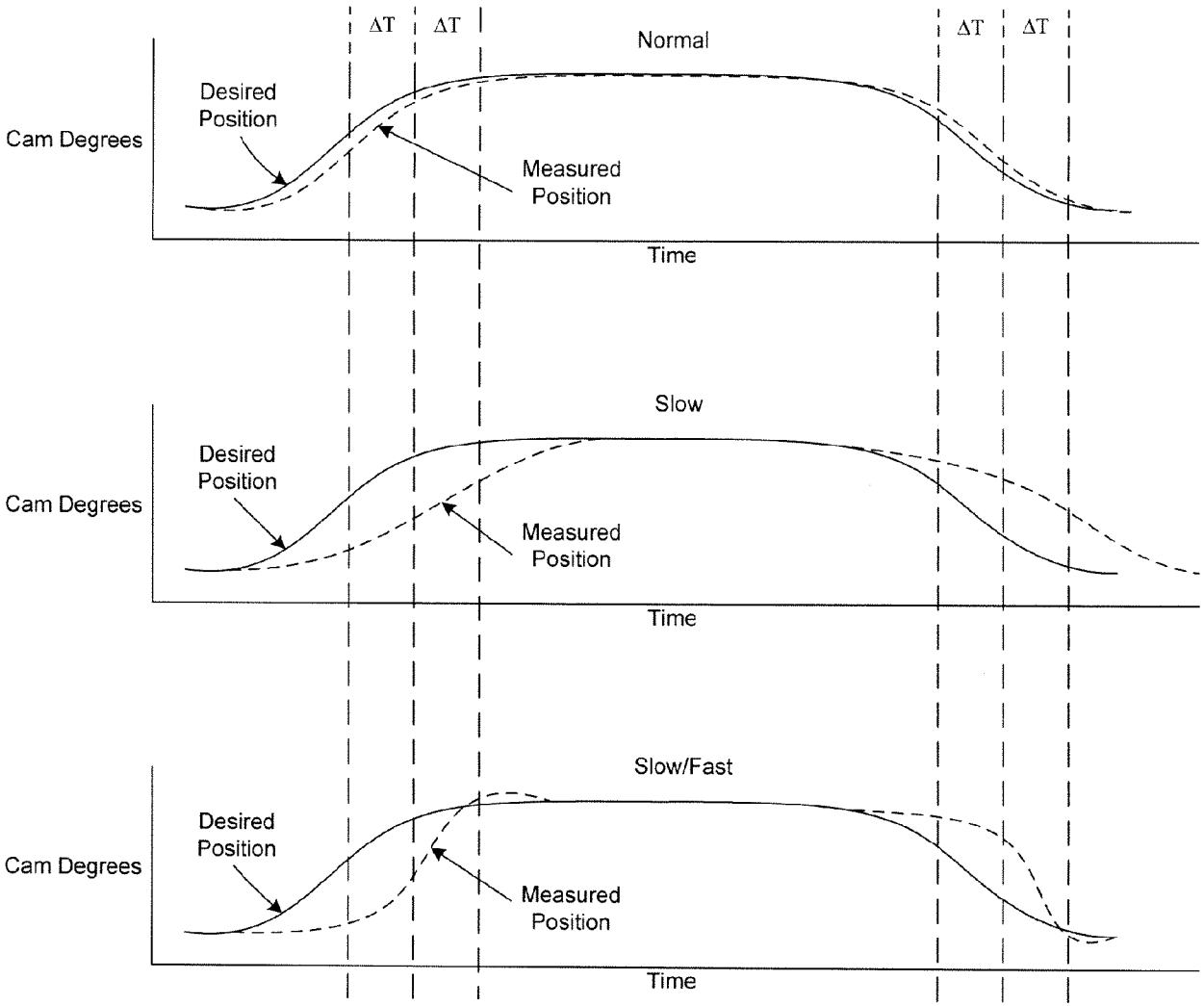
FIG. 3 is a graph illustrating exemplary cam phaser position data indicating fast operation, slow operation, and normal operation.

The evaluation module 56 receives as input the difference 66. Based on the difference 66, the evaluation module 56 sets a degradation identifier 68 to indicate that the cam phaser is operating at least one of normal, slow, or fast. In various embodiments, the degradation identifier 68 is implemented as an enumeration with values of normal operation, slow operation, and fast operation. As shown in FIG. 3, generally, the difference 66 will be small when the cam phaser hardware is operating normally. The difference 66 will be large and positive when the cam phaser hardware is operating slower than expected. The difference 66 will be similarly large and negative when the cam phaser hardware is operating faster than expected.

Referring back to FIG. 2, the evaluation module 56 additionally can set a cam phaser fault status 70 to indicate faulty cam phaser operation when the intake and/or exhaust cam phaser is operating slower or faster than expected. For example, the evaluation module 56 can set the cam phaser fault status 70 to indicate faulty operation when the difference 66 indicates the phaser hardware is operating slower than expected for X consecutive evaluation periods or for X evaluation periods out of a total of Y evaluation periods. As can be appreciated, once the cam phaser fault status 70 is set to indicate faulty cam phaser operation, additional steps can be performed to notify other systems and users of the fault. In various embodiments, a diagnostic code is set based on the cam phaser fault status 70. The diagnostic code can be retrieved by a service tool or transmitted to a remote location via a telematics system. In various other embodiments, an indicator lamp is illuminated based on the cam phaser fault status 70. In various other embodiments, an audio warning signal is generated based on the cam phaser fault status 70.

Figure 4:
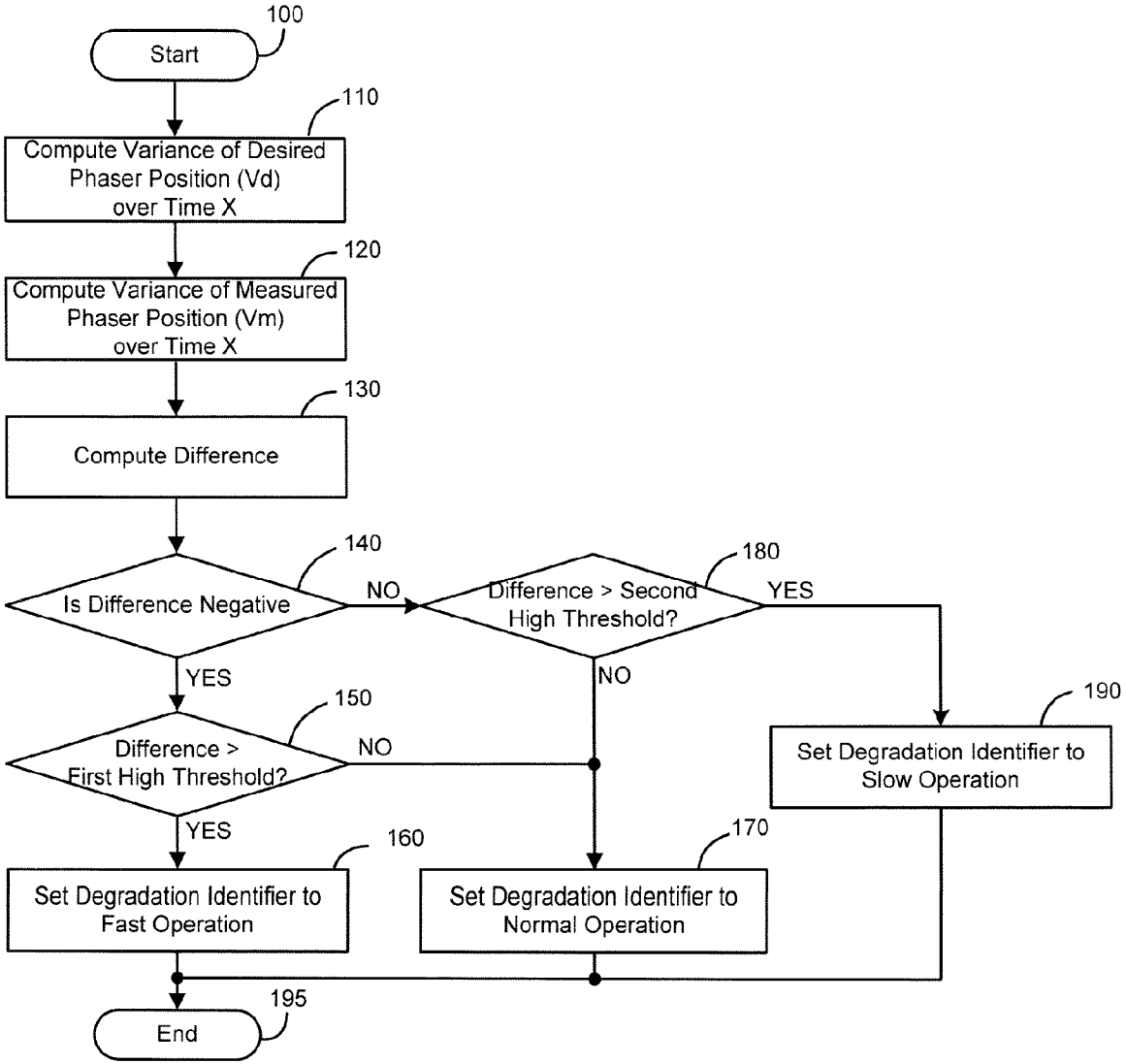
FIG. 4 is a flowchart illustrating an exemplary cam phaser diagnostic method that can be performed by the cam phaser diagnostic system in accordance with various aspects of the present disclosure.

Referring now to FIG. 4, a flowchart illustrates an exemplary cam phaser diagnostic method that can be performed by the cam phaser diagnostic system of FIG. 2 in accordance with various aspects of the present disclosure. As can be appreciated, the order of execution of the steps of the exemplary cam phaser diagnostic method can vary without altering the spirit of the method. The exemplary method may be performed periodically during control module operation or scheduled to run based on certain events.

In one example, the method may begin at 100. A sample desired variance 60 of the desired cam phaser position 58 over a sample period is computed at 110. A sample measured variance 64 of the measured cam phaser position 39 over the same sample period is computed at 120. The difference 66 between the sample desired variance 60 and the sample measured variance 64 is computed at 130.

The difference 66 is then evaluated at 140, 150, and 180. If the difference 66 is negative at 140, the difference 66 is compared with a first high threshold at 150. If the difference 66 is greater than the first high threshold (indicating the negative difference is large) at 150, the degradation identifier 68 is set to fast operation at 160. Otherwise, if the difference 66 is negative at 140 and the difference 66 less than the first high threshold (indicating the negative difference is small) at 150, the degradation identifier 68 is set to normal operation at 170. Otherwise, if the difference 66 is not negative (i.e., positive) at 140, the difference 66 is compared with a second high threshold at 180. If the difference 66 is greater than the second high threshold (indicating the positive difference is large) at 180, the degradation identifier 68 is set to slow operation at 190. Otherwise, if the difference 66 is not negative (i.e., positive) at 140 and the difference 66 is less than the second high threshold (indicating the positive difference is small) at 180, the degradation identifier 68 is set to normal operation at 170. Thereafter, the method may end at 195.

Figure 5:
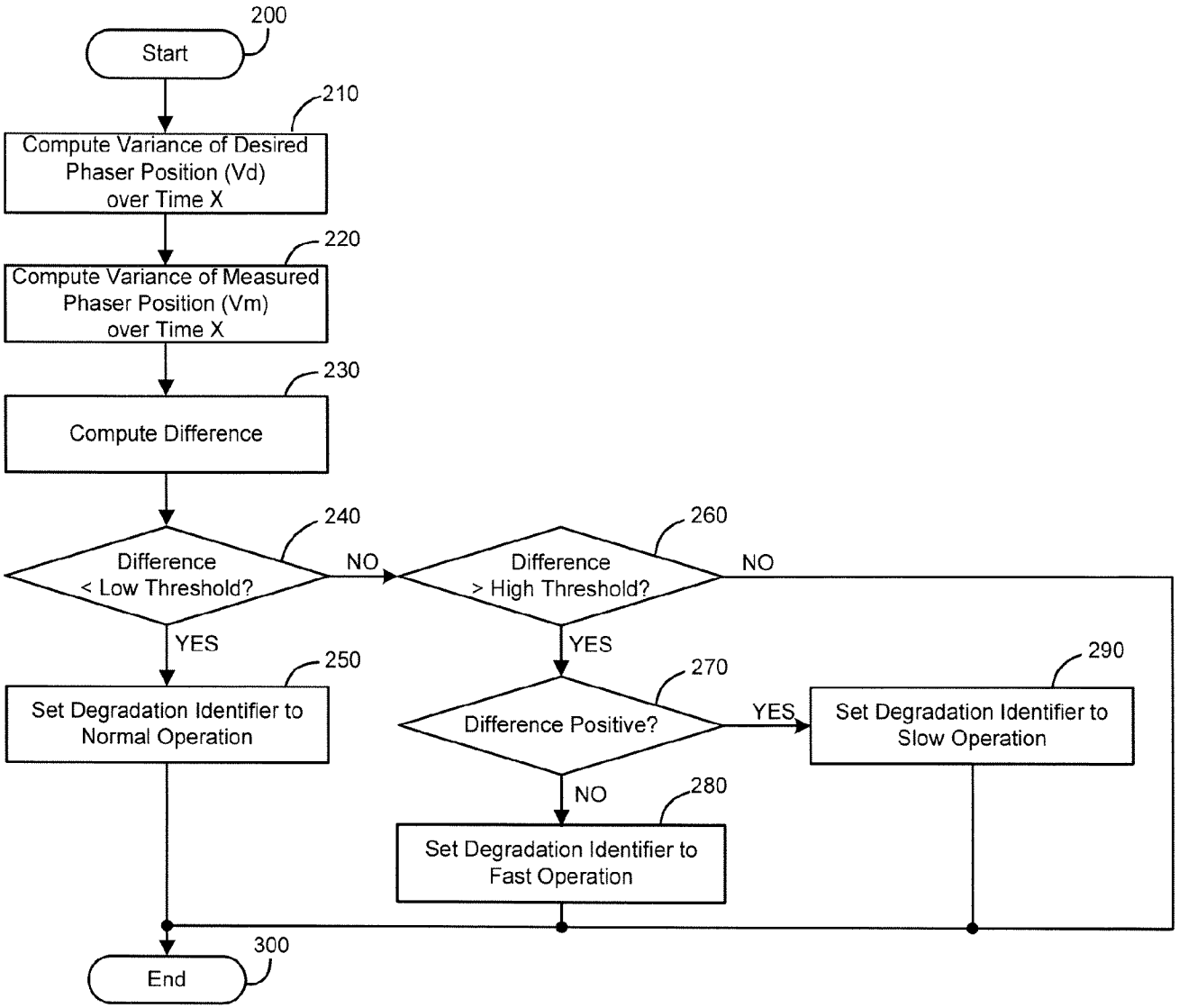
FIG. 5 is a flowchart illustrating another exemplary cam phaser diagnostic method that can be performed by the cam phaser diagnostic system in accordance with various aspects of the present disclosure.

Referring now to FIG. 5, a flowchart illustrates various other embodiments of an exemplary cam phaser diagnostic method that can be performed by the cam phaser diagnostic system of FIG. 2 in accordance with various aspects of the present disclosure. As can be appreciated, the order of execution of the steps of the exemplary cam phaser diagnostic method can vary without altering the spirit of the method. The exemplary method may be performed periodically during control module operation or scheduled to run based on certain events.

In various aspects, in place of implementing two high thresholds, one for positive and one for negative, the cam phaser diagnostic method can implement a common high threshold. As can be appreciated, comparisons to one or more high thresholds and/or one or more low thresholds can be implemented in the cam phaser diagnostic method to distinguish the difference as being small or large. To illustrate, another example is provided. For example, the method may begin at 200. A sample desired variance 60 of the desired cam phaser position 58 over a sample period is computed at 210. A sample measured variance 64 of the measured cam phaser position 39 over the same sample period is computed at 220. The difference 66 between the sample desired variance 60 and the sample measured variance 64 is computed at 230.

The difference 66 is evaluated at 240, 260, and 270. If the difference 66 is less than a predetermined low threshold (indicating the difference is small) at 240, the degradation identifier 68 is set to normal operation at 250. However, if the difference 66 is greater than the low threshold at 240, the difference 66 is greater than a high threshold (indicating the difference is large) at 260, and the difference 66 is positive at 270, the degradation identifier 68 is set to slow operation at 290. Otherwise, if the difference 66 is greater than the low threshold at 240, the difference 66 is greater than the high threshold (indicating the difference is large) at 260, and the difference is not positive (i.e., negative) at 270, the degradation identifier 68 is set to fast operation at 280. Thereafter, the method may end at 300.

As can be appreciated, all comparisons discussed above can be implemented in various forms depending on the selected values for comparison. For example, a comparison of "greater than" may be implemented as "greater than or equal to" in various embodiments. Similarly, a comparison of "less than" may be implemented as "less than or equal to" in various embodiments. A comparison of "within a range" may be equivalently implemented as a comparison of "less than or equal to a maximum threshold" and "greater than or equal to a minimum threshold" in various embodiments.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, specification, and the following claims.

What is claimed is:

1. A cam phaser diagnostic system, comprising:

a first sample variance module that computes a first variance based on a desired cam phaser position, wherein the first variance is a square of a standard deviation;

a second sample variance module that computes a second variance based on a measured cam phaser position, wherein the second variance is a square of a standard deviation; and an evaluation module that diagnoses faulty cam phaser operation based on the first variance and the second variance.

2. The system of claim 1 further comprising a difference module that computes a difference between the first variance and the second variance and wherein the evaluation module diagnoses the cam phaser based on the difference.

3. The system of claim 2 wherein the evaluation module diagnoses the cam phaser based on whether the difference is at least one of positive and negative.

4. The system of claim 2 wherein the evaluation module diagnoses the cam phaser based on a comparison of the difference to a high threshold.

5. The system of claim 4 wherein the evaluation module diagnoses that the cam phaser is not operating as expected when the difference is greater than the high threshold.

6. The system of claim 4 wherein the evaluation module diagnoses the cam phaser based on a comparison to a low threshold, wherein the low threshold is less than the high threshold.

7. The system of claim 4 wherein the evaluation module diagnoses that the cam phaser is operating as expected when the difference is less than the high threshold.

8. The system of claim 2 wherein the evaluation module diagnoses that the cam phaser is moving slower than expected when the difference is greater than a high threshold and the difference is positive.

9. The system of claim 2 wherein the evaluation module diagnoses that the cam phaser is moving faster than expected when the difference is greater than a high threshold and the difference is negative.

10. The system of claim 1 wherein the evaluation module sets a cam phaser fault status based on the diagnosing of the cam phaser.

11. A method of diagnosing a cam phaser, comprising:

computing a first variance based on a desired cam phaser position, wherein the first variance is a square of a standard deviation;

computing a second variance based on a measured cam phaser position, wherein the second variance is a square of a standard deviation; and diagnosing faulty cam phaser operation based on the first variance and the second variance.

12. The method of claim 11 further comprising computing a difference between the first variance and the second variance and wherein the diagnosing is based on the difference.

13. The method of claim 12 wherein the diagnosing comprises diagnosing that the cam phaser is not operating as expected when the difference is greater than a first threshold.

14. The method of claim 13 wherein the diagnosing comprises diagnosing that the cam phaser is operating as expected when the difference is less than a second threshold, wherein the first threshold is greater than the second threshold.

15. The method of claim 13 wherein the diagnosing comprises diagnosing that the cam phaser is moving slower than expected when the difference is greater than the first threshold and the difference is positive.

16. The method of claim 13 wherein the diagnosing comprises diagnosing that the cam phaser is moving faster than expected when the difference is greater than the first threshold and the difference is negative.

17. The method of claim 12 wherein the diagnosing comprises diagnosing that the cam phaser based on whether the difference is at least one of positive and negative.

18. The method of claim 11 further comprising setting a cam phaser fault status based on the diagnosing of the cam phaser.

* * * * *